US011583921B2

(12) United States Patent
Kwon

(10) Patent No.: US 11,583,921 B2
(45) **Date of Patent: *Feb. 21, 2023**

(54) METHOD OF MANUFACTURING ALUMINUM ALLOY CLAD SECTION, AND ALUMINUM ALLOY CLAD SECTION PRODUCED BY SAME METHOD

(71) Applicant: Pukyong National University Industry-University Cooperation Foundation, Busan (KR)

(72) Inventor: Hansang Kwon, Busan (KR)

(73) Assignee: Pukyong National University Industry-University Cooperation Foundation, Busan (KR)

( * ) Notice: Subject to any disclaimer, the term of this patent is extended or adjusted under 35 U.S.C. 154(b) by 331 days.

This patent is subject to a terminal disclaimer.

(21) Appl. No.: 16/427,582

(22) Filed: May 31, 2019

(65) Prior Publication Data

US 2020/0298308 A1 Sep. 24, 2020

(30) Foreign Application Priority Data

Mar. 22, 2019 (KR) ..... 10-2019-0033100

(51) Int. Cl.
*B22F 3/20* (2006.01)
*B22F 3/105* (2006.01)
(Continued)

(52) U.S. Cl.
CPC ..... *B22F 3/20* (2013.01); *B22F 3/105* (2013.01); *B22F 7/008* (2013.01); *B22F 9/04* (2013.01);
(Continued)

(58) Field of Classification Search
CPC ..... B21C 33/00; B21C 33/002; B21C 33/004; B21C 33/006; B21C 33/008;
(Continued)

(56) References Cited

U.S. PATENT DOCUMENTS 6,481,177 B1 * 11/2002 Wood ..... F16B 7/187 52/656.9
2001/0051045 A1 * 12/2001 Kobayashi ..... G03B 17/04 396/178
(Continued)

FOREIGN PATENT DOCUMENTS

CN 105734322 A * 7/2016 ..... B21C 23/24
KR 20160149735 A * 12/2016
KR 101822073 B1 * 1/2018

OTHER PUBLICATIONS

Hansang Kwon, Mehdi Estili, Kenta Takagi, Takamichi Miyazaki, Akira Kawasaki, "Combination of hot extrusion and spark plasma sintering for producing carbon nanotube reinforced aluminum matrix composites," Carbon, 47 (2009), pp. 570-577. (Year: 2009).*
(Continued)

*Primary Examiner* — Vanessa T. Luk
(74) *Attorney, Agent, or Firm* — Harness, Dickey & Pierce, P.L.C.

(57) ABSTRACT

Disclosed are a method of manufacturing an aluminum alloy clad section, and an aluminum alloy clad section manufactured by the method. The method includes preparing a composite powder by ball-milling aluminum powder and carbon nanotubes, preparing a billet from the composite powder, and subjecting the billet to direct extrusion using an extrusion die. The method is simple in procedure and uses simple equipment because it is based on direct extrusion which is suitable for mass production. Thus, the method is capable of producing a lightweight high-strength functional aluminum alloy clad section having a competitive advantage in terms of price over conventional aluminum alloy clad sections.

7 Claims, 9 Drawing Sheets

(51) Int. Cl.
*B22F 7/00* (2006.01)
*B22F 9/04* (2006.01)

(52) U.S. Cl.
CPC ... *B22F 2009/043* (2013.01); *B22F 2301/052* (2013.01); *B22F 2302/403* (2013.01); *B22F 2303/40* (2013.01)

(58) Field of Classification Search
CPC ..... B22F 1/0003; B22F 1/0025; B22F 1/004; B22F 1/0044; B22F 1/0059; B22F 1/0062; B22F 3/004; B22F 3/02; B22F 3/03; B22F 3/12; B22F 3/1208; B22F 3/1216; B22F 3/1241; B22F 3/14; B22F 3/15; B22F 3/156; B22F 3/16; B22F 3/162; B22F 3/164; B22F 3/168; B22F 3/20; B22F 3/204; B22F 3/23; B22F 3/105; B22F 2003/023; B22F 2003/1051; B22F 2003/1052; B22F 2003/1053; B22F 2003/1054; B22F 2003/153; B22F 2003/202; B22F 2003/206; B22F 2003/208; B22F 5/00; B22F 5/106; B22F 7/008; B22F 7/02; B22F 7/04; B22F 7/08; B22F 2207/01; B22F 2301/052; B22F 2302/403; B22F 2303/40; C22C 1/0416; C22C 1/05; C22C 1/058; C22C 1/10; C22C 1/1005; C22C 1/101; C22C 1/1015; C22C 1/1084; C22C 21/00; C22C 21/003; C22C 21/006; C22C 21/02; C22C 21/04; C22C 21/06; C22C 21/08; C22C 21/10; C22C 21/12; C22C 21/14; C22C 21/16; C22C 21/18; C22C 2026/002; C22C 32/0084
See application file for complete search history.

(56) References Cited

U.S. PATENT DOCUMENTS

2011/0068299 A1* 3/2011 Hong ..... C22C 26/00 252/182.33
2012/0164429 A1* 6/2012 Shah ..... B82Y 30/00 428/293.1

OTHER PUBLICATIONS

Dason Kim, Kwangjae Park, Kyungju Kim, Takamichi Miyazaki, Sungwook Joo, Sanghwui Hong, Hansang Kwon, "Carbon nanotubes-reinforced aluminum alloy functionally graded materials fabricated by powder extrusion process," Materials Science & Engineering A, 745 (available online Jan. 2, 2019), pp. 379-389. (Year: 2019).*

* cited by examiner

METHOD OF MANUFACTURING ALUMINUM ALLOY CLAD SECTION, AND ALUMINUM ALLOY CLAD SECTION PRODUCED BY SAME METHOD

CROSS REFERENCE TO RELATED APPLICATION

The present application claims priority to Korean Patent Application No. 10-2019-0033100 (filed Mar. 22, 2019), the entire contents of which is incorporated herein for all purposes by this reference.

BACKGROUND OF THE DISCLOSURE

1. Field of the Disclosure

The present invention relates to a method of manufacturing an aluminum alloy clad section, and an aluminum alloy clad section manufactured by the same method. More particularly, the present invention relates to a method of manufacturing a lightweight high-strength functional aluminum alloy clad section, the method being based on direct extrusion which is suitable for mass production due to its simple procedure and equipment, thereby being capable of producing the lightweight high-strength functional aluminum alloy clad section having a competitive advantage in terms of price. The present invention also relates to an aluminum alloy clad section produced by the same method.

2. Description of the Background Art

Aluminum is widely used in various industrial fields. For example, it is used in: airplanes, automobiles, ships, railways, etc. due to its low specific gravity (i.e., lightness); power transmission lines due to its good electric conductivity; industrial tableware and the like due to its strong corrosion resistance in the air and harmless to human body; and paint, aluminum foil packaging, building materials, reactor materials, and so on.

In addition, since aluminum is high in malleability and ductility, aluminum can be processed into all shapes and profiles, such as rods, tubes, plates, foils, and wires. Typically, when producing a product having a certain cross-section, for example, a rod, pipe, or wire, an aluminum alloy clad section is manufactured by using an extrusion apparatus.

However, despite the various advantages described above, utilization and application of aluminum alloy clad sections are not active because of their relatively weak mechanical and physical properties. To obtain aluminum alloy clad sections capable of withstanding in diverse extreme conditions, it is necessary to improve corrosion resistance, mechanical properties, and processability of aluminum alloys by preparing a heterogeneous composite material containing aluminum and other materials.

In recent years, as industrial parts have had more and more complicated shapes and designs, there have been many issues regarding installation of high-strength parts in a small space. That is, the demand for high-strength lightweight materials is increasing. To follow this industrial trend, aluminum alloy clad sections are also required to be lighter and have higher strength and functionality.

SUMMARY OF THE DISCLOSURE

An object of the present invention is to provide a method of manufacturing a light high-strength functional aluminum alloy clad section having a competitive advantage in terms of price by employing a direct extrusion process which is suitable for mass production due to its simple procedure and simple equipment.

Another object of the present invention is to provide an aluminum alloy clad section produced by the above-described method.

According to one aspect of the present invention, there is provided a method of manufacturing an aluminum alloy clad section, the method including: preparing a composite powder by ball-milling aluminum powder and carbon nanotubes (CNT); preparing a billet from the composite powder; and directly extruding the billet by using an extrusion die.

The billet may include a first billet having a can shape, a second billet disposed inside the first billet, and a third billet disposed inside the second billet, wherein the second billet, the third billet, or both include the composite powder, and the second billet and the third billet may have different parts by volume of the carbon nanotubes with respect to 100 parts by volume of the aluminum powder in the respective composite powders thereof.

The composite powder may include 100 parts by volume of the aluminum powder and 0.01 to 10 parts by volume of the carbon nanotubes.

The ball-milling may be performed at a low speed ranging from 150 to 300 rpm or at a high speed of 300 or more rpm, for a duration of 12 hours to 48 hours, with 100 to 1500 parts by volume of milling balls and 10 to 50 parts by volume of an organic solvent with respect to 100 parts by volume of the composite powder in a horizontal or planetary ball mill.

The organic solvent may be heptane.

The second billet may include 0.09 to 10 parts by volume of the carbon nanotubes with respect to 100 parts by volume of the aluminum powder and the third billet may include 0 to 0.08 parts by volume of the carbon nanotubes with respect to 100 parts by volume of the aluminum powder.

The preparing of the billet may include compressing the composite powder at a high pressure of 10 to 100 MPa.

The preparing of the billet may include spark plasma sintering of the composite powder at a pressure of 30 to 100 MPa and a temperature of 280° C. to 600° C. for a duration of 1 second to 30 minutes.

The extrusion die may be a hollow die.

The extruding may include: a billet splitting step of splitting, in a direction perpendicular to a diameter of a cylinder, the billet into multiple pieces; a joining step of charging the multiple pieces into a joining chamber to join the pieces to form a hollow cylinder; and an extrusion step of directly extruding the hollow cylinder to form a joined hollow billet.

The aluminum alloy clad section may be any one member selected from the group consisting of a rod, a tube, a plate, a sheet, a wire, a profile, and an angle.

The profile may include a profile body and a plurality of T-shaped slots arranged in a circumferential direction of the profile body and extending along a longitudinal direction of the profile body, in which the profile body includes the composite powder, the plurality of T-shaped slots are arranged with barriers interposed therebetween, and each of the barriers between each of the T-shaped slots includes 0.09 to 10 parts by volume of the carbon nanotubes with respect to 100 parts by volume of the aluminum powder.

The aluminum alloy clad section may be a camera body case.

Another object of the present invention is to provide an aluminum alloy clad section produced by the method described above.

The manufacturing method of the present invention uses a direct extrusion process which is suitable for mass production. Thus, the manufacturing method of the present invention is simple in procedure and requires simple equipment, resulting in production of aluminum alloy clad sections having a competitive advantage in terms of price. That is, the manufacturing method of the present invention is capable of mass production of a lighter high-strength functional aluminum alloy clad section.

BRIEF DESCRIPTION OF THE DRAWINGS

The above and other objects, features, and other advantages of the present disclosure will be more clearly understood from the following detailed description when taken in conjunction with the accompanying drawings, in which.

DETAILED DESCRIPTION OF THE DISCLOSURE

Hereinafter, embodiments of the present invention will be described in detail. However, it should be understood that the present invention is not limited thereto, and the present invention is only defined by the scope of the following claims.

Figure 1:
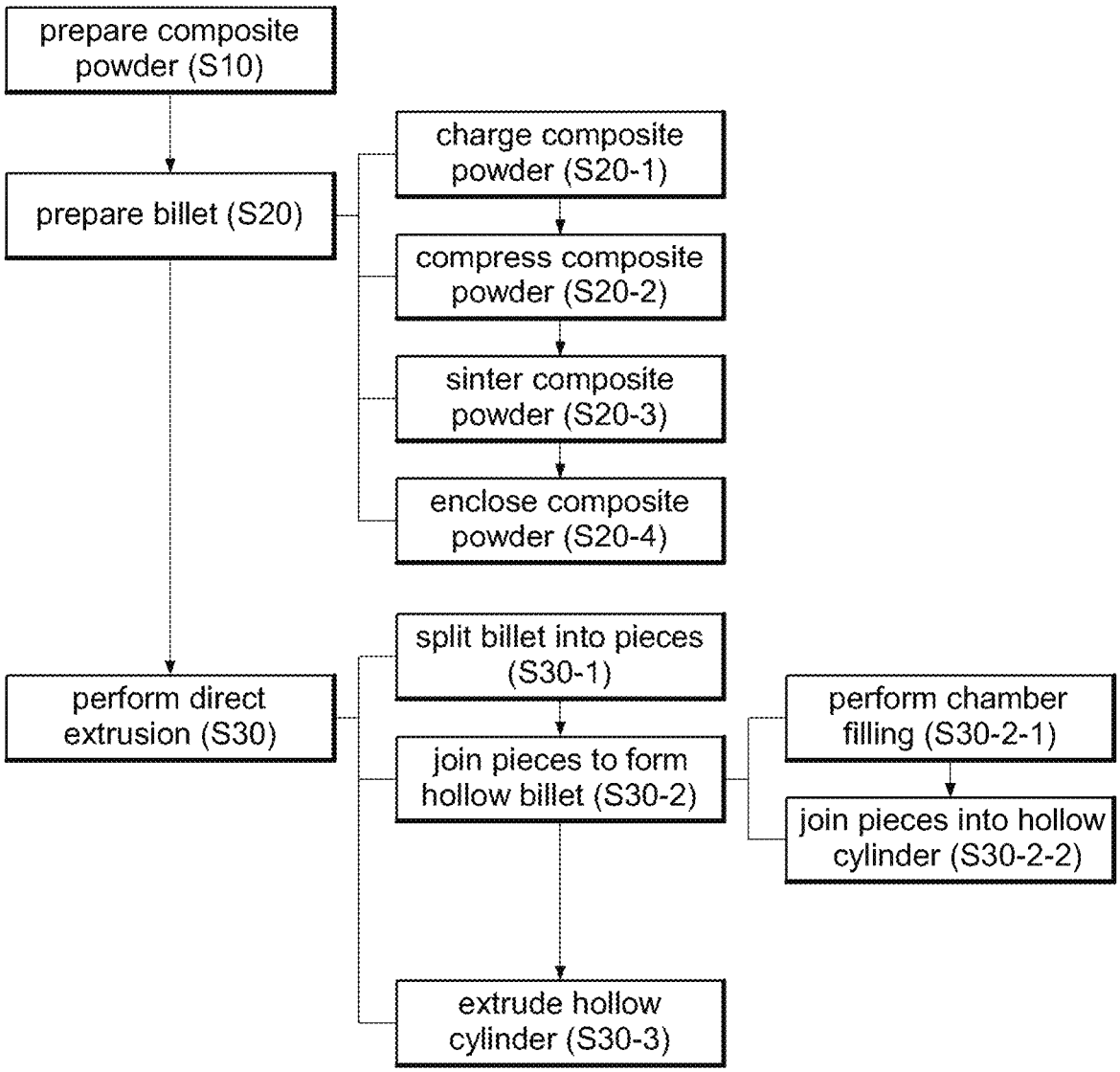
FIG. 1 is a flowchart of a method of manufacturing an aluminum alloy clad section according to one embodiment of the present invention.

FIG. 1 is a flowchart of a method of manufacturing an aluminum alloy clad section according to one embodiment of the present invention. Hereinafter, a method of manufacturing an aluminum alloy clad section will be described with reference to FIG. 1.

Referring to FIG. 1, a method of manufacturing an aluminum alloy clad section according to one embodiment of the present invention includes: a composite powder preparation step S10 of preparing a composite powder by ball-milling aluminum powder and carbon nanotubes (CNT); a billet preparation step S20 of preparing a billet; and a direct extrusion step S30 of directly extruding the billet using an extrusion die.

First, aluminum powder and carbon nanotubes (CNT) are ball-milled to produce a composite powder in step S10.

The aluminum powder may be pure aluminum powder or pure aluminum alloy powder. In the case of pure aluminum alloy powder, an aluminum alloy selected from the group consisting of aluminum alloys of 1000 series, 2000 series, 3000 series, 4000 series, 5000 series, 6000 series, 7000 series, and 8000 is used. In addition, recycled powder can be used as the aluminum powder.

The composite powder contains carbon nanotubes. Therefore, the aluminum alloy clad section made from the composite powder has high strength and conductivity and a light weight. Therefore, the aluminum alloy clad section made from the composite powder can be used, as a new super material, in various machines such as automotive, aerospace, aircraft, or the like as well as can used for producing a heat sink or a power transmission wire.

The composite powder may include an additional metal powder besides the aluminum powder. The additional metal powder is the powder of any metal selected from the group consisting of copper, magnesium, titanium, stainless steel, tungsten, cobalt, nickel, tin and alloys thereof. In addition, recycled powder may be used as the aluminum powder.

When preparing the composite powder, there are problems that micro-sized aluminum particles are difficult to disperse due to a large size difference from nano-sized carbon nanotubes and the carbon nanotubes easily agglomerate by a strong Van der Waals force. Therefore, a dispersion agent is added to uniformly blend the carbon nanotubes and the aluminum particles.

The dispersion agent is the powder of a nano-sized ceramic selected from the group consisting of nano-SiC, nano-$SiO_2$, nano-$Al_2O_3$, nano-$TiO_2$, nano-$Fe_3O_4$, nano-MgO, nano-$ZrO_2$ and mixtures thereof.

The nano-sized ceramic particles uniformly disperse the carbon nanotubes among the aluminum particles. Since the nano-sized silicon carbide (SiC) has a high tensile strength, sharpness, constant electrical conductivity, constant thermal conductivity, high hardness, high fire resistance, high resistance to thermal shock, high chemical stability at high temperatures, it is widely used as an abrasive or a fireproofing agent. In addition, the nano-sized SiC particles present on the surfaces of the aluminum particles have a function of preventing direct contact between the carbon nanotubes and the aluminum particles to inhibit formation of undesirable aluminum carbide which is formed through reaction between the carbon nanotubes and the aluminum particles.

The composite powder includes 100 parts by volume of the aluminum powder and 0.01 to 10 parts by volume of the carbon nanotubes.

When the content of the carbon nanotubes is less than 0.01 part by volume with respect to 100 parts by volume of the aluminum powder, the strength of an aluminum alloy clad section made from the composite powder is similar to that of a pure aluminum clad section. That is, in that range of the content of the carbon nanotubes, the composite powder cannot play a role as a reinforcing material. Conversely, when the content exceeds 10 parts by volume, there is a disadvantage that an elongation decreases although the strength of an aluminum alloy clad section made from the composite powder is higher than that of a pure aluminum clad section. In addition, when the content of the carbon nanotubes is excessively large, the carbon nanotubes hinder dispersion of the aluminum particles and degrade mechanical and physical properties by serving as defect sites.

When the dispersion agent is added, the composite powder contains 0.1 to 10 parts by volume of the dispersion agent with respect to 100 parts by volume of the aluminum powder.

When the content of the dispersion agent is less than 0.1 part by volume with respect to 100 parts by volume of the aluminum powder, the dispersion inducing effect is insignificant. Conversely, when the content exceeds 10 parts by volume, the dispersion agent rather hinders dispersion of the aluminum particles because it causes the carbon nanotubes to agglomerate.

A horizontal or planetary ball mill is used for the ball milling. The ball milling is performed in a nitrogen or argon ambient at a low speed ranging from 150 to 300 rpm or a high speed of 300 rpm or higher for a duration of 12 to 48 hours.

The ball milling begins by charging 100 to 1500 parts by volume of stainless steel balls (in which balls with a diameter of 10 ø and balls with a diameter of 20 ø are mixed in a ratio of 1:1) into a stainless steel container with respect to 100 parts by volume of the composite powder.

To reduce the coefficient of friction, any one organic solvent selected from the group consisting of heptane, hexane, and alcohol is used as a process control agent. In this case, the process control agent is added by 10 to 50 parts by volume with respect to 100 parts by volume of the composite powder. After completion of the ball milling, the stainless steel container is opened so that the organic solvent can be volatilized, leaving only a mixture of the aluminum powder and the carbon nanotubes.

The dispersion agent (herein, nano-sized ceramic particles) plays the same role as the nano-sized milling balls due to the rotational force generated during the ball milling process, thereby physically separating the agglomerated carbon nanotubes and improving the fluidity of the carbon nanotubes. Thus, the carbon nanotubes can be uniformly dispersed on the surfaces of the aluminum particles.

Next, a billet is made from the obtained composite powder in step S20.

Figure 2:
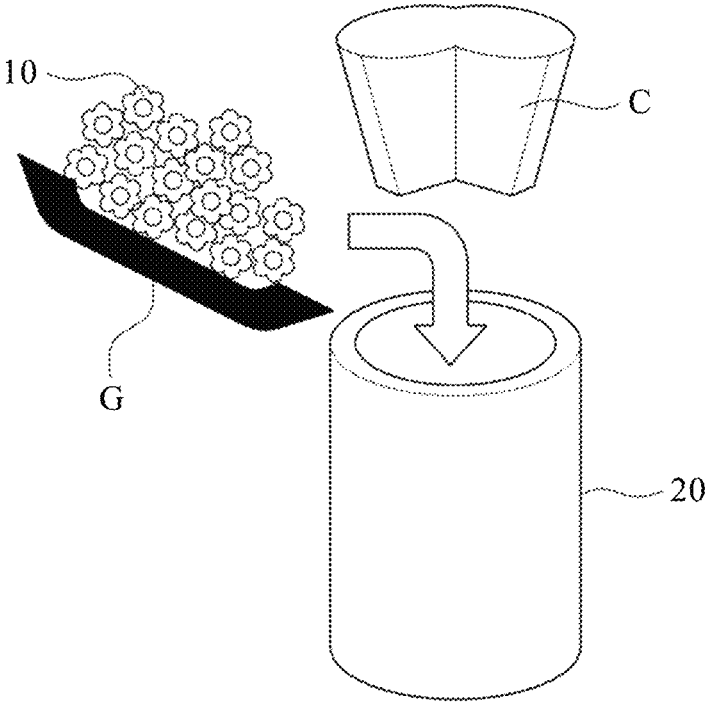
FIG. 2 is a diagram schematically illustrating a billet preparation process.

FIG. 2 is a diagram schematically illustrating a billet preparation process. Referring to FIG. 2, the billet is prepared by charging the composite powder 10 into a metal can 20 through a guider G in step S20-1. The metal can 20 is capped with a cap C or the composite powder in the metal can 20 is compressed so that the composite powder cannot flow out of the metal can 20 in step S20-4.

The metal can 20 is made of any metal being thermally and electrically conductive. Preferably, the metal can 20 is made of aluminum, copper, magnesium. The thickness of the metal can 20 ranges from 0.5 to 150 mm when a 6-inch billet is used, but it varies depending on the size of the billet used.

Figure 3:
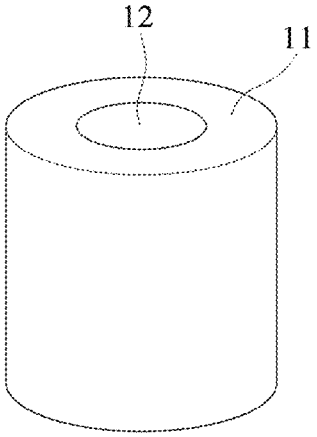
FIG. 3 is a perspective view schematically illustrating an example of a composite billet.
Figure 4:
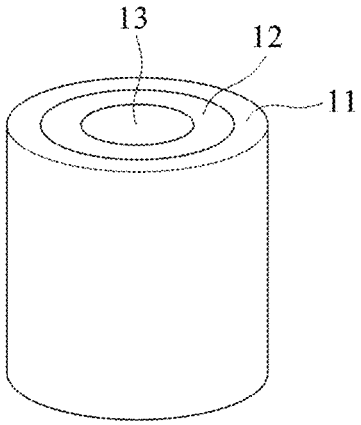
FIG. 4 is a perspective view schematically illustrating another example of the composite billet.

FIGS. 3 and 4 are perspective views schematically illustrating examples of billets that can be manufactured by the method of the present invention.

Referring to FIG. 3, a composite billet is manufactured by placing a second billet 12 in a first billet 11 having a hollow cylindrical shape, in which the materials of the first billet 11 and the second billet 11 have different compositions.

The first billet 11 has a hollow cylindrical shape. That is, the first billet 11 is in the form of a can with one end closed or a hollow cylinder with both ends being open. The first billet 11 is made of aluminum, copper, magnesium, or the like. The first billet 11 having a hollow cylinder shape is manufactured by melting a base metal and injecting molten metal into a mold. Alternatively, it can be manufactured by machining a base metal block.

The second billet 12 includes the prepared composite powder. The second billet 12 is in the form of a mass or powder.

When the second billet 12 is in the form of a mass, the second billet 12 specifically has a cylinder shape. The composite billet is prepared by placing the cylindrical second billet 12 in the first billet 11. To prepare the composite billet in which the second billet 12 is placed in the first billet 11, the composite powder to form the second billet 12 is melted, the molten material is injected into a mold to form a cylindrical member, and the cylindrical member is inserted into the first billet 11. Alternatively, the composite powder is directly charged into the cavity of the first billet 11.

Referring to FIG. 4, a third billet 13 having a different composition from the second billet 12 is disposed in the cavity of the second billet 12.

The third billet 13 is in the form of a mass or powder. Since the description of the second billet 12 applies to the third billet 13. A redundant description of the third billet 13 will not be given.

When the second billet 12, the third billet 13, or both are in the form of a mass of the composite powder, the mass of the composite powder is produced by compressing the composite powder at a high pressure or sintering the composite powder.

The volume of carbon nanotubes with respect to 100 parts by volume of the aluminum powder differ between the composite powders of the second billet 12 and the third billet 13. That is, in FIG. 4, in the second billet 12 and the third billet 13, the volume parts of carbon nanotubes with respect to 100 parts by volume of the aluminum powder 100 differ.

The composite powder of the second billet 12 contains 0.09 to 10 parts by volume of the carbon nanotubes with respect to 100 parts by volume of the aluminum powder, and the composite powder of the third billet contains 0 to 0.08 part by volume of the carbon nanotubes with respect to 100 parts by volume of the aluminum powder.

Alternatively, the second billet 12 is made of the composite powder, and the third billet 13 is a metal mass or powder selected from the group consisting of aluminum, copper, magnesium, titanium, stainless steel, tungsten, cobalt, nickel, tin, and alloys thereof.

Of the total volume of the composite billet, the second billet accounts for 0.01 to 10 vol %, the third billet accounts for 0.01 to 10 vol %, and the first billet 11 accounts for the rest.

The composite billet may include one or more additional billets provided between the first billet 11 and the second billet 12 and/or between the second billet 12 and the third billet 13. The number of the additional billets is not particularly limited in the present invention. For example, 10 or fewer additional billets may be included. Since the description of the additional billets is the same as that of the second billet 12, a redundant description will not be given. Each of the additional billets includes the composite powder. The composite powder contained in the second billet 12 and the composite powder contained in the third billet 13 may include different parts by volume of the carbon nanotubes with respect to 100 parts by volume of the aluminum powder.

When manufacturing a profile (for example, a camera body case or the like) having a plurality of T-shaped slots by subjecting the composite billet described above to a direct extrusion process, it is possible to locally enhance the strength of the profile. That is, it is possible to improve the strength of a relatively mechanically weak region where the thickness is relatively thin, for example, barriers between the T-shaped slots.

Since the composite billet includes the second billet 12 or the third billet 13 containing the composite powder, the composite billet is compressed at a high pressure of 10 to 100 MPa in step S20-2.

By compressing the composite billet, it is possible to directly extrude the composite billet using an extrusion die. When the composite powder is compressed at a pressure lower than 10 MPa, the manufactured aluminum alloy clad section is likely to have pores and the composite powder is likely to flow down. When the composite powder is compressed at a pressure higher than 100 MPa, the second and onward billets are likely to expand.

Since the composite billet includes the second billet and/or the third billet containing the composite powder, the composite billet is sintered to be directly extruded through the extrusion die in step S20-3.

For this sintering, any sintering apparatus can be used. For example, a spark plasma sintering apparatus or a hot press sintering apparatus is used. However, when it is necessary to perform precise sintering in a short time, it is preferable to use discharge plasma sintering. In this case, discharge plasma sintering is performed at a temperature of 280° C. to 600° C. for a duration of 1 second to 30 minutes under a pressure of 30 to 100 MPa.

Next, the billet is directly extruded using an extrusion die to produce an aluminum alloy clad section in step S30.

Figure 5:
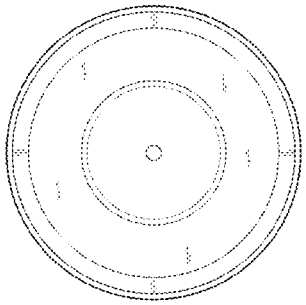
FIG. 5 is a plan view schematically illustrating a solid die.

The extrusion die is a solid die, a hollow die, or a semi-hollow die. FIG. 5 is a plan view schematically illustrating a solid die, and FIG. 6 is a plan view schematically illustrating a hollow die.

For example, a solid die is used to produce an rod-shaped aluminum alloy clad section and a hollow die is used to produce an tube-shaped or profile-shaped aluminum alloy clad section. Hereinafter, a direct extrusion process using a hollow die will be described.

Figure 6:
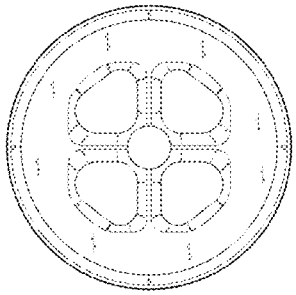
FIG. 6 is a plan view schematically illustrating a hollow die.

Referring to FIG. 6, a hollow die is a die having a plurality of holes. The number of the holes of the hollow die is determined depending on how many pieces into which a billet is to be divided. The number of holes of the hollow die is, for example, two, three, four, or more. The number of holes of the hollow die is not particularly limited in the present invention. In FIG. 6, the hollow die has four holes.

Specifically, the direct extrusion process S30 includes: a billet splitting step S30-1 of splitting, in a direction perpendicular to a diameter of a cylinder, the billet into pieces; a joining step S30-2 of introducing the pieces into a joining chamber to form a hollow cylinder; and an extrusion step S30-3 of directly extruding the hollow cylinder.

Figure 7:
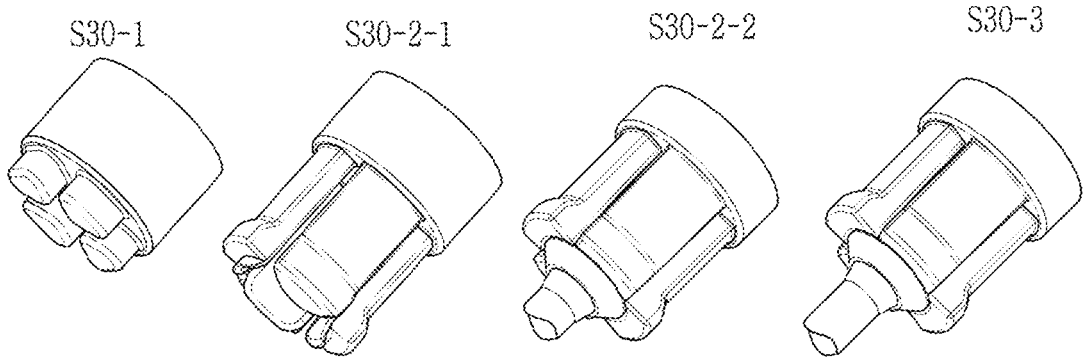
FIG. 7 is a view illustrating each stage of changing of the shape of a billet during direct extrusion.

FIG. 7 is a view illustrating each stage illustrating how the billet changes during the direct extrusion process. Referring to FIG. 7, the billet is divided into two or more pieces in the direction perpendicular to the diameter of the cylinder by a hollow die in step S30-1. FIG. 7 illustrates an example in which the billet is divided into four pieces by the hollow die.

The pieces are introduced into a joining chamber to fill the chamber in step S30-2-1, and then the pieces are joined together to form a hollow cylinder in step S30-2-2. After that, the hollow cylinder is directly extruded in step S30-3. Since the manufacturing method of an aluminum alloy clad section involves the billet splitting step and the billet joining step, the produced aluminum alloy clad section has two or more seams in terms of the radial direction.

In the direct extrusion process, a die angle ranges from 400° to 550°, an extrusion ratio ranges from 15 to 20, an extrusion rate ranges from 2 to 10 mm/s, an extrusion pressure ranges from 150 to 200 kg/cm$^2$, and a billet temperature ranges from 350° to 550° C. The extrusion ratio is a ratio of the cross-sectional area of the billet to the cross-sectional area of the aluminum alloy clad section resulting from the process.

When the composite billet includes the second billet made of the composite powder and/or the third billet (which means one or more billets subsequent to the second billet), when directly extruding the composite billet using an extrusion die, it is necessary to compress or sinter the composite billet at a high pressure as described above.

The method of manufacturing an aluminum alloy clad section may additionally include a post-treatment step such as heat treatment. Regarding the heat treatment, in the case of manufacturing an aluminum alloy clad section using the above-described manufacturing method, a better heat treatment effect can be obtained even under conventional heat treatment conditions than the case where an aluminum alloy clad section is manufactured using a conventional method.

An aluminum alloy clad section according to another embodiment of the present invention can be manufactured by using the method described above.

The aluminum alloy clad section produced by using the direct extrusion has any shape selected from the group consisting of a rod, a tube, a plate, a sheet, a wire, an angle, and a profile. Specifically, the aluminum alloy clad section produced by the direct extrusion is in the form of a tube or a profile. More specifically, the aluminum alloy clad section can be used as a camera body case.

Aluminum tubes and the like produced by the manufacturing method described above can be used as pneumatic or hydraulic cylinders, multifunctional camera body cases, composite wires, or pipes and chassis members for various industrial materials. The profile has a T-shaped slot structure. In this case, profiles produced by the manufacturing method described above can be assembled without involving a welding process. Since the profiles with T-shaped slots are simple in structure and can be assembled in a short time, when the profiles are used to construct a framework, it is possible to reduce time and labor required for construction of the framework.

Figure 8:
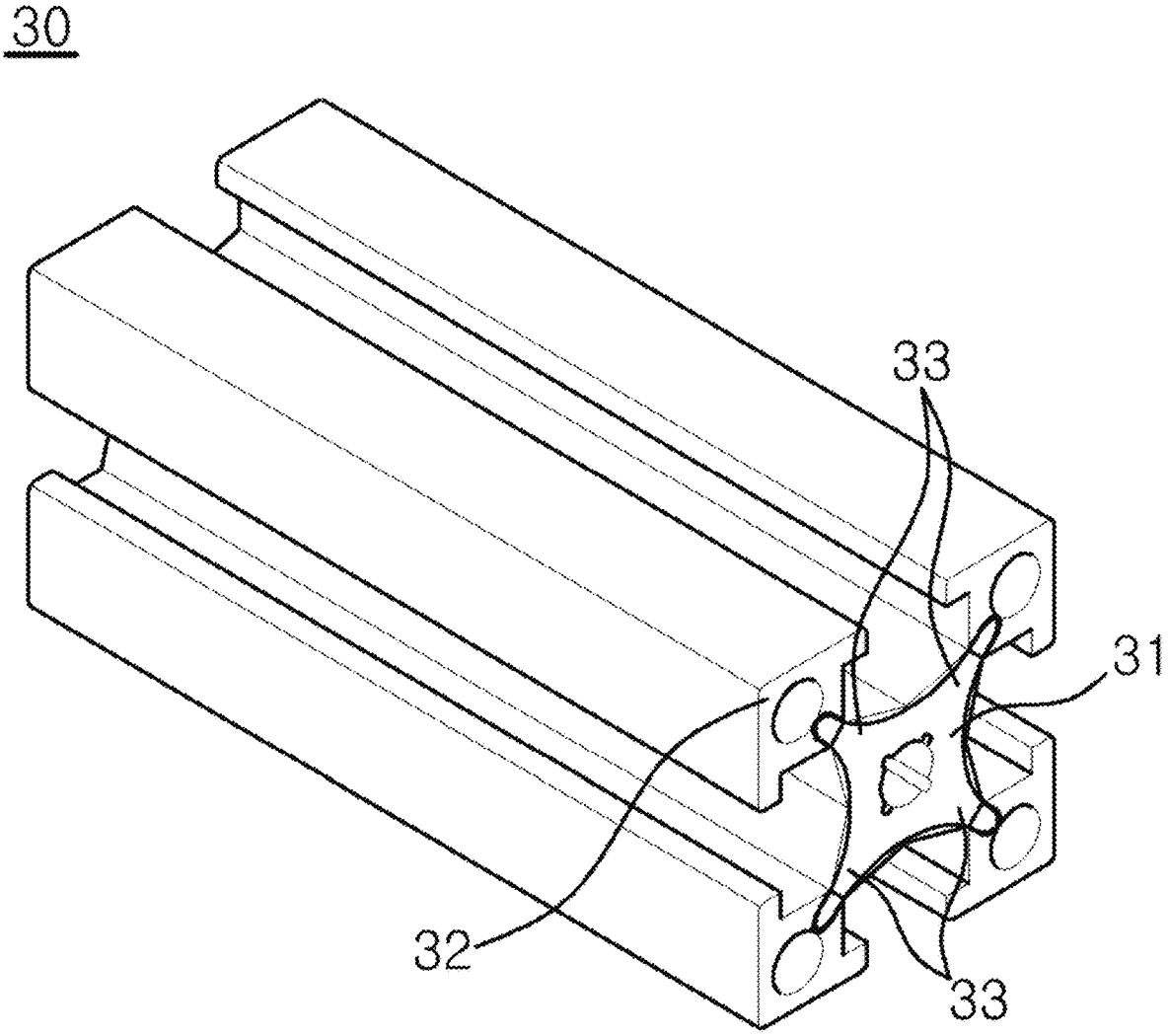
FIG. 8 is a perspective view illustrating an example of a profile.

FIG. 8 is a perspective view illustrating an example of a profile. Referring to FIG. 8, a profile 30 includes a profile body 31 and at least one T-shaped slot 32 extending along a longitudinal direction of the profile body 31.

The T-shaped slot 32 has an opening that longitudinally extends. The T-shaped slot 32 is formed to be recessed inward to receive a fixing part such as a T-shaped bolt or nut.

The profile 30 may have multiple T-shaped slots 32 arranged in the circumferential direction of the profile body 31. The T-shaped slots 32 are defined by barriers 33 interposed therebetween. In FIG. 8, the profile 30 has four T-shaped slots 32 arranged on four flank surfaces of the profile body 31.

As illustrated in FIG. 8, since the barriers 33 (i.e. connectors) formed to isolate the T-shaped slots 32 from each other and to connect the T-shaped slots 32 and the profile body 31 has a small thickness, the strength of the profile 30 is likely to be weak. In order to enhance the strength of the profile 30, the profile body 31 is made of a material containing 0 to about 0.08 parts by volume of carbon nanotubes with respect to 100 parts by volume of aluminum powder, and a portion of the barriers provided between each of the T-shaped slots 32 is made of a material containing 0.09 to 10 parts by volume of carbon nanotubes with respect to 100 parts by volume of the aluminum powder. That is, by increasing the content of the carbon nanotubes of the material of a portion of the barriers between the T-shaped slots 32, the strength of the barriers 33 between the T-shaped slots 32 is enhanced.

The profile 30 is manufactured by: preparing a composite billet including a first billet that is can-shaped, a second billet disposed inside the first billet, and a third billet disposed inside the second billet, in which the second billet, the third billet, or both are made from the composite powder described above; compressing or sintering the composite billet; and directly extruding the composite billet.

The third billet of the composite billet turns into the profile body 31 through the direction extrusion. The third billet contains 0 to 0.08 part by volume of carbon nanotubes with respect to 100 parts by volume of aluminum powder.

The second billet turns into the barriers 33 provided between the T-shaped slots 32 through the direct extrusion. The second billet contains 0.09 to 10 parts by volume of the carbon nanotubes with respect to 100 parts by volume of the aluminum powder.

Figure 9:
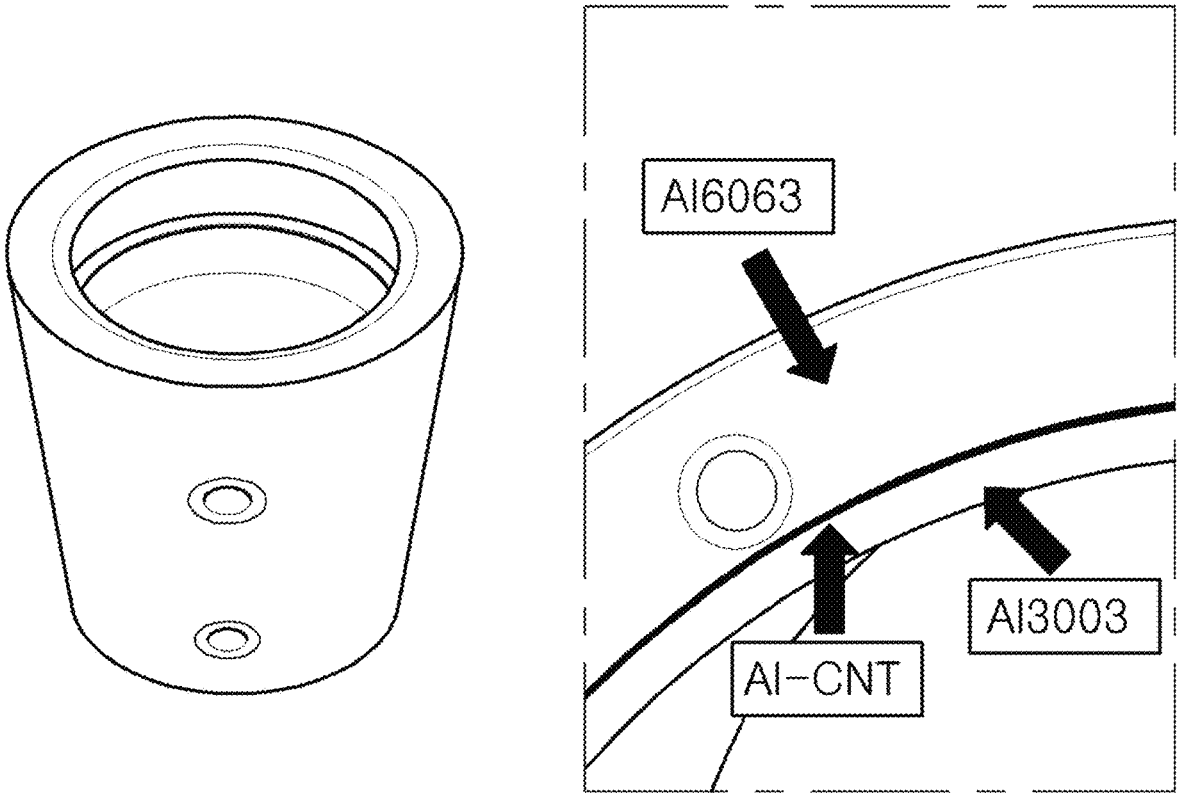
FIG. 9 is a photograph illustrating an example of a camera body case.

FIG. 9 is a photograph illustrating an example of a camera body case.

Referring to FIG. 9, the camera body case has a cylindrical shape. The cylindrical body includes three layers: an outer layer, an inner layer, and an intermediate layer positioned between the outer layer and the inner layer.

In this case, for example, the outer layer is made of an aluminum alloy (Al6063), the inner layer is made of an aluminum ally (Al3003), and the intermediate layer is made of an Al-CNT composite powder (Al-CNT).

The camera body case is manufactured through the steps of: preparing a composite billet composed of a first billet having a hollow cylinder shape and made of Al6003, a third billet having a columnar shape, made of Al3003, and disposed in the first billet, and a layer of the composite powder infilled between the first billet and the third billet; compressing or sintering the composite billet; and directly extruding the composite billet.

Hereinafter, specific examples of the present invention will be described. However, the examples described below are only intended to illustrate or explain the present invention, and the present invention is not limited thereto. In addition, technologies that can be inferred by those skilled in the art from the description provided herein will not be described to avoid a redundant description.

Preparation Example 1: Preparation of Profile-Shaped Aluminum Alloy Clad Section

Example 1

Carbon nanotubes (manufactured by SCSiAl headquartered in Luxembourg) having a purity of 99.5%, a diameter of 10 nm or less, and a length of 30 μm or less were used. Aluminum powder (manufactured by MetalPlayer headquartered in Korea) having an average particle size of 45 μm and a purity of 99.8% was used.

A composite billet was prepared such that a third billet having a solid cylinder shape was positioned at the center of a metal can serving as a first billet and a second billet (composite powder) was infilled between the first billet and the third billet.

The second billet includes aluminum-CNT composite powder containing 0.1 parts by volume of the carbon nanotubes with respect to 100 parts by volume of the aluminum powder. The first billet was made of an aluminum alloy (Al6063), and the third billet was made of an aluminum alloy (Al3003).

The second billet was prepared in a manner described below. 100 parts by volume of the aluminum powder and 0.1 parts by volume of the carbon nanotubes were introduced into a stainless steel container to fill 30% of the total volume of the stainless steel. Stainless steel milling balls (including balls having a diameter of 20 ø and balls having a diameter of 10 ø) were introduced into the container by 30% of the total volume of the container, and 50 ml of heptane was added to the mixture in the stainless steel container. The mixture was ball-milled at a low speed of 250 rpm) for 24 hours using a horizontal ball mill. Then, the container was opened to allow the heptane to be completely volatilized and then the aluminum-CNT composite powder was collected.

The aluminum-CNT composite powder thus prepared was charged into a gap 2.5 t between the first billet and the third billet and compressed at a pressure of 100 MPa to prepare the composite billet.

The prepared composite billet was directly extruded using a direct extruder equipped with a hollow die having four holes under the conditions of an extrusion ratio of 100, an extrusion rate of 5 mm/s, an extrusion pressure of 200 $kg/cm^2$, and a billet temperature of 460° C. Thus, an aluminum alloy clad section having a profile shape having four T-shaped slots illustrated in FIG. 8 was manufactured.

Example 2

In the same manner as in Example 1, an aluminum-CNT composite powder containing 1 part by volume of the carbon nanotubes was prepared and a composite billet was prepared by using the aluminum-CNT composite powder.

The composite billet was directly extruded under the same conditions as in Example 1 to produce an aluminum alloy clad section having a profile shape having four T-shaped slots.

Example 3

In the same manner as in Example 1, an aluminum-CNT composite powder containing 3 parts by volume of the carbon nanotubes was prepared and a composite billet was prepared by using the aluminum-CNT composite powder.

The composite billet was directly extruded under the same conditions as in Example 1 to produce an aluminum alloy clad section having a profile shape having four T-shaped slots.

Comparative Example 1

A mixture of CNT 10 wt % and aluminum powder 80 wt. % were blended with a dispersion agent (a 1:1 mixture of solvent and natural rubber solution) in a ratio of 1:1 and then exposed to ultrasonic waves for 12 minutes to prepare a dispersion mixture. The dispersion mixture was heat-treated in an inert ambient at a temperature of 500° C. in a tubular furnace for 1.5 hours. Through the heat treatment, the dispersion agent was completely removed (volatilized), leaving only the aluminum-CNT composite powder.

The aluminum-CNT composite powder thus prepared was charged into an aluminum can having a diameter of 12 mm and a thickness of 1.5 mm. The mixture was then extruded with a hot extruder (model UH-500 kN, manufactured by Shimadzu Corporation, Japan) at an extrusion temperature of 450° C. and an extrusion ratio of 20 to produce an aluminum alloy clad section having a profile shape having four T-shaped slots.

Experimental Example 1: Measurement of Mechanical Properties of Aluminum Alloy Clad Section Tensile strength, elongation, and Vickers hardness of the aluminum alloy clad sections prepared according to Examples and Comparative Examples were measured. The results are shown in Table 1.

The tensile strength and elongation were measured according to Korean Industrial Standards (KS), under test conditions of a tensile speed of 2 mm/s. Test specimens were prepared according to KS B0802 No. 4 (test specimen). The Vickers hardness was measured under conditions of 300 g and 15 seconds.

TABLE

| | Tensile Strength (MPa) | Elongation (%) | Vickers Hardness (Hv) |
|---|---|---|---|
| Example 1 | 165 | 21 | 38 |
| Example 2 | 203 | 18 | 68 |
| Example 3 | 195 | 15 | 60 |
| Comparative Example 1 | 190 | 10 | 100 |
| Al6063 [1)] | 120 | 28 | 30 |
| Al3003 [2)] | 100 | 31 | 28 |

[1)] Al6063: Aluminum 6063
[2)] Al3003: Aluminum 3003

Referring to Table 1, the aluminum alloy clad sections prepared according to Examples 1 to 3 have high strength and ductility as compared with aluminum alloy clad sections extruded using a rigid material (Al6063) and a soft material (Al3003).

The aluminum alloy clad section in Comparative Example 1 has a high Vickers hardness but a very low elongation.

Experimental Example 2: Measurement of Corrosion Resistance of Aluminum Alloy Clad Section The corrosion resistance characteristics of the aluminum alloy clad sections according to Example 2 and Comparative Example 1 were measured. The results are shown in Table 2.

The characteristics were measured by using a seawater spraying method for specimens having a size of 10×10 mm and a thickness of 2 mm according to the CASS standard.

TABLE 2

| | CASS Corrosion Resistance | Thermal Conductivity ($W \cdot m^{-1} \cdot K^{-1}$) |
|---|---|---|
| Example 2 | 400 or more | 268 |
| Comparative Example 1 | 320 | 210 |
| Al6063 [1)] | 200 | 194 |
| Al3003 [2)] | 300 | 190 |

[1)] Al6063: Aluminum 6063
[2)] Al3003: Aluminum 3003

Referring to Table 2, the aluminum alloy clad sections according to Example 2 exhibited better corrosion resistance than the aluminum alloy clad sections made of a high strength material (Al6063) and a high corrosion resistance material (Al3003), although only a small amount of CNT was added thereto. That is, the corrosion resistance was greatly improved in comparison an aluminum clad section with no CNT added. In addition, the aluminum alloy clad section produced according to Comparative Example 1 exhibited superior corrosion resistance to a pure aluminum alloy but inferior corrosion resistance to the aluminum alloy clad section according to Example 2.

While the present invention has been described with reference to exemplary embodiments, those skilled in the art will appreciate that the present invention is not limited to the disclosed exemplary embodiments and rather various modifications and improvements can be made without departing from the basic concept of the present invention defined by the appended claims.

What is claimed is:

1. A method of manufacturing an aluminum alloy clad section, the method comprising:

preparing a composite powder by ball-milling aluminum powder and carbon nanotubes (CNT);

preparing a billet using the composite powder; and directly extruding the billet using an extrusion die, wherein the billet includes a first billet that is can-shaped, a second billet disposed inside the first billet, and a third billet disposed inside the second billet, wherein the first billet is made of aluminum, wherein both the second billet and the third billet comprise the composite powder, wherein the preparing a billet comprises preparing the first billet by melting aluminum and injecting the molten aluminum into a mold, and preparing each of the second billet and the third billet by subjecting the composite powder to spark plasma sintering performed at a temperature of 280 to 600° C. and a pressure of 30 to 100 MPa for a duration of 1 second to 30 minutes and extruding the sintered composite powder using the extrusion die, and wherein the second billet comprises 0.09 to 10 parts by volume of the carbon nanotubes with respect to 100 parts by volume of the aluminum powder, and the third billet comprises 0.08 part by volume of the carbon nanotubes with respect to 100 parts by volume of the aluminum powder.

2. The method according to claim 1, wherein the ball-milling is performed at a low speed ranging from 150 to 300 rpm or at a high speed of 300 or more rpm for a duration of 12 hours to 48 hours, in a horizontal or planetary ball mill into which 100 to 1500 parts by volume of milling balls and 10 to 50 parts by volume of an organic solvent with respect to 100 parts by volume of the composite powder are introduced.

3. The method according to claim 2, wherein the organic solvent is heptane.

4. The method according to claim 1, wherein the extrusion die is a hollow die.

5. The method according to claim 4, wherein the extruding comprises:

splitting the billet in a direction perpendicular to a diameter of the billet into multiple pieces using the hollow die;

joining the pieces to form a hollow member by introducing the pieces into a joining chamber; and directly extruding the hollow member to form a joined hollow billet.

6. The method according to claim 1, wherein the aluminum alloy clad section has any one shape selected from the group consisting of a rod, a tube, a plate, a sheet, a wire, a profile, and an angle.

7. The method according to claim 6, wherein the aluminum alloy clad section is a camera body case.

* * * * *